US010080707B2

(12) United States Patent
Dunn et al.

(10) Patent No.: US 10,080,707 B2
(45) Date of Patent: Sep. 25, 2018

(54) MODULAR PACIFIER ASSEMBLY

(71) Applicant: MUNCHKIN, INC., Van Nuys, CA (US)

(72) Inventors: Steven Bryan Dunn, Beverly Hills, CA (US); Nairi Khachikian, Glendale, CA (US); Sung Yun Chan, Pasadena, CA (US); Matthew Joseph Saxton, Agoura, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 14/201,699

(22) Filed: Mar. 7, 2014

(65) Prior Publication Data

US 2014/0257388 A1 Sep. 11, 2014

Related U.S. Application Data

(60) Provisional application No. 61/775,418, filed on Mar. 8, 2013.

(51) Int. Cl.
*A61J 17/00* (2006.01)
*A45F 5/02* (2006.01)

(52) U.S. Cl.
CPC ..... *A61J 17/008* (2015.05); *A45F 5/02* (2013.01); *A61J 17/001* (2015.05); *A61J 17/00* (2013.01)

(58) Field of Classification Search
CPC .. A45F 5/02; A61J 17/001; A61J 17/00; A61J 17/008
See application file for complete search history.

(56) References Cited

U.S. PATENT DOCUMENTS

| | | | | |
|---|---|---|---|---|
| 2,834,350 | A * | 5/1958 | Beck, Jr. | A61J 17/00 606/236 |
| 2,860,639 | A * | 11/1958 | Hoover | A61J 17/00 606/234 |
| 3,339,771 | A * | 9/1967 | Ballin | A61J 9/008 215/11.6 |
| 3,556,104 | A * | 1/1971 | Janklow | A61J 17/00 24/543 |
| 5,156,617 | A * | 10/1992 | Reid | A61J 17/00 606/234 |
| 5,211,656 | A * | 5/1993 | Maddocks | A61J 17/00 606/234 |
| 5,964,784 | A * | 10/1999 | Wang | A61J 17/00 606/234 |
| 6,228,105 | B1 * | 5/2001 | Johansen | A61J 17/00 606/234 |
| 6,638,298 | B1 * | 10/2003 | Shefflin | A45C 11/24 606/234 |
| 2005/0065551 | A1 * | 3/2005 | Rosuck | A61J 17/00 606/234 |
| 2005/0159779 | A1 * | 7/2005 | Schwartz | A45F 5/02 606/234 |

(Continued)

*Primary Examiner* — Jing Ou
(74) *Attorney, Agent, or Firm* — Robert Z. Evora, Esq.; Christian Lek

(57) ABSTRACT

A pacifier assembly including a compressible pacifier, a cover, a clip and a strap. The compressible pacifier has a nipple with a radial base which is secured between a ring and a handle. The cover is adapted to be secured to the compressible pacifier while the clip is adapted to be fastened to a general object. The strap is attached to the clip at a first end and the compressible pacifier at a second end.

16 Claims, 8 Drawing Sheets

(56) References Cited

U.S. PATENT DOCUMENTS

| | | | | |
|---|---|---|---|---|
| 2005/0261739 | A1* | 11/2005 | Chen | A61J 17/00 606/234 |
| 2006/0135997 | A1* | 6/2006 | Carmona | A61J 17/00 606/234 |
| 2010/0030265 | A1* | 2/2010 | Ambrite | A44C 5/0007 606/236 |
| 2013/0089276 | A1* | 4/2013 | Noble | B65D 85/00 383/42 |

* cited by examiner

FIG. 11
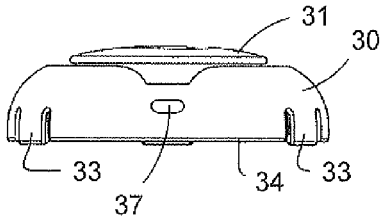
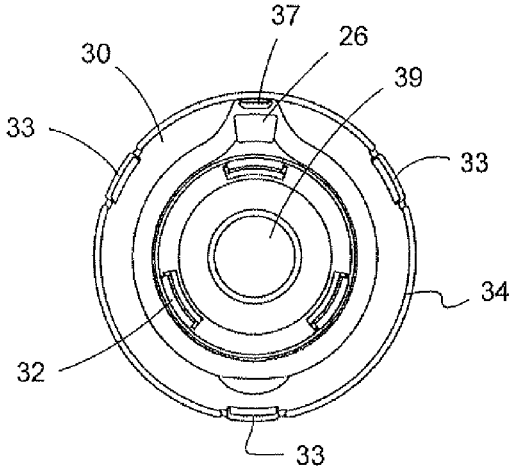
FIG. 10
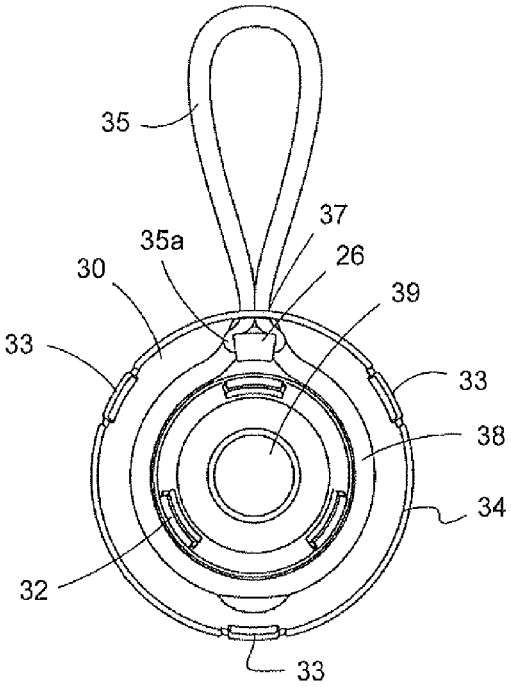
FIG. 12

MODULAR PACIFIER ASSEMBLY

CROSS REFERENCE TO RELATED APPLICATION

This application claims priority to U.S. Provisional Patent Application Ser. No. 61/775,418, filed Mar. 8, 2013; the contents of which are hereby incorporated by reference herein in their entirety into this disclosure.

TECHNICAL FIELD

The subject disclosure relates to a protective pacifier nipple assembly, and in particular to a collapsible pacifier having an outer shield adapted to protect the nipple of the pacifier from unsanitary bacteria.

BACKGROUND

Conventionally, pacifiers are prone to collecting dirt and other unsanitary bacteria. Young infants and/or parents have the tendency to inadvertently drop the infant's pacifier on the floor or other unsanitary surface. In a conventional nipple-type pacifier, the nursing end of the nipple is directly exposed externally and will make direct contact with the unclean surface. Unfortunately, a frail still unvaccinated infant may be subjected to various contagious pathogens and the resultant diseases thereof.

BRIEF DESCRIPTION OF THE DRAWINGS

Various exemplary embodiments of this disclosure will be described in detail, wherein like reference numerals refer to identical or similar components or steps, with reference to the following figures, wherein:

FIG. 10 illustrates a rear view of the cover.

FIG. 11 depicts a top view of the cover.

FIG. 12 show a rear view of the cover with the flexible band disposed there-through.

DETAILED DESCRIPTION

Particular embodiments of the present invention will now be described in greater detail with reference to the figures.

Figure 1:
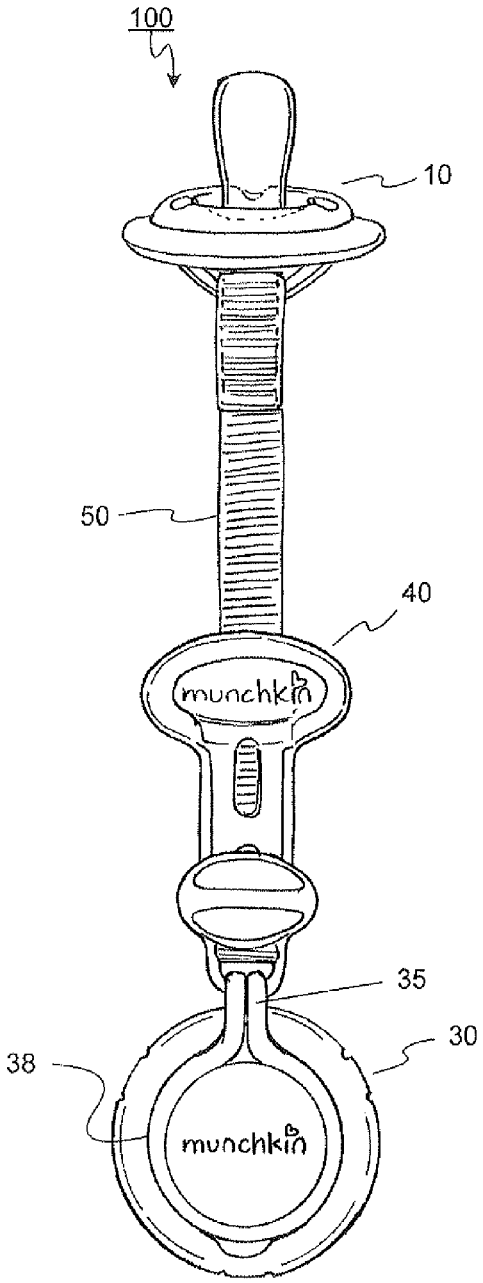
FIG. 1 illustrates a front view of an exemplary compressible pacifier assembly according to the subject disclosure.

FIG. 1 shows an exemplary collapsible pacifier assembly 100. The modular structure of the collapsible pacifier assembly 100 comprises a collapsible pacifier 10, a cover 30, a fastener 40, and a strap 50.

Figure 2:
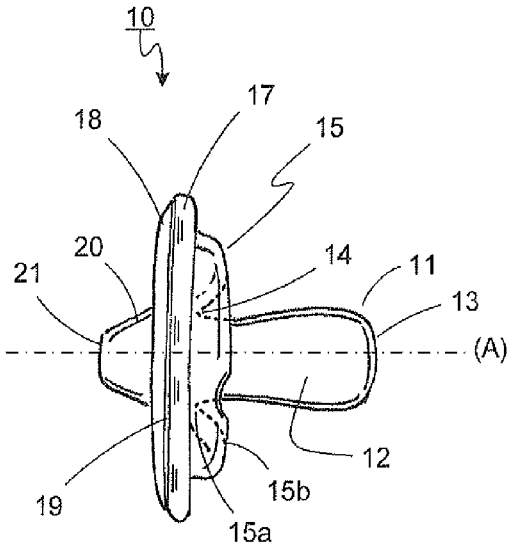
FIG. 2 shows a side view of an exemplary compressible pacifier.
Figure 3:
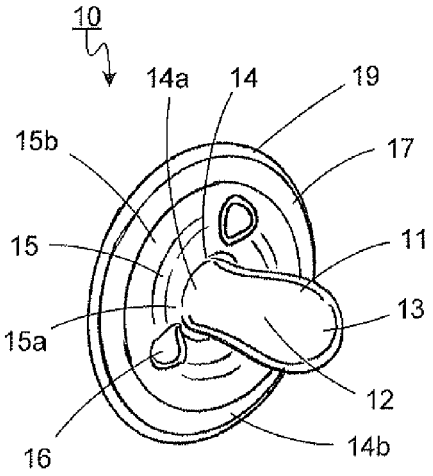
FIG. 3 depicts a perspective view of the compressible pacifier.

FIGS. 2-3, in more detail show the collapsible pacifier 10 includes a nipple 11 having a shaft 12 with a tip 13 at one end, and a concentric base 14 at the opposite end. The nipple 11 has a circular cross-sectional shape that tapers outward along a longitudinal axis (A) of the nipple 10 from the base 14 to the tip 13. The tip 13 is preferably generally hemispherical in shape. The shaft 12 is preferably made of a relatively soft material, such as an elastomer or the like. Although the shaft 12 is shown as being a hollow tube, it may be solid. One skilled in the art will recognize that there are many shapes, sizes and compositions of nipples which may be used with a pacifier of the present invention.

The concentric base 14 provides the compressible pacifier 10 with a mouth shield and comprises a membrane of flexible material. The base 14 may include a generally semi-toroid shaped fold 15 that allows the shaft 12 to reciprocate along its longitudinal axis (A) as an infant alternatingly sucks and releases it. The base 14 is connected at one end 14*a* to the shaft 12 of the nipple 11 and extends radially outward to a peripheral end 14*b*.

The fold 15 is preferably concentric with the shaft 12, but need not be. For example, a cylindrical shaft 12 may be surrounded by an elliptical fold or the like. Similarly, an annular fold may be used with a shaft having an elliptical or other non-circular cross-sectional shape. Although a base having a generally concavoconvex shape is shown, the base may have another shape such as planar. Moreover, it is to be understood that the base may include more than one fold or none at all.

After use, the nipple 11 can be cleaned easily by pulling the shaft 12 out of the fold 15 such that the portion of a membrane that forms the fold 15 is stretched and made taught. In this position, the exterior of the shaft 12 and the base 14 generally facing the tip 13 are easily accessed for cleaning.

Various apertures 16 may be provided in the base 22 in, or adjacent to, the fold 15. The apertures 16 provide ventilation for the portion of an infant's face that contacts the base 14 when the infant is using the compressible pacifier 10. Although two apertures are shown, any number of apertures, or none at all, may be provided. In addition, the apertures may be located on the base anywhere desired.

The fold 15 in the base 14 may be constructed to have an inner periphery 15*a* portion and an outer periphery 15*b* portion. The inner periphery 15*a* portion being attached to the shaft 12. The shaft 12 and base 14 are preferably formed integrally with one another and made of the same material. However, they may be formed separately from the same or different materials and joined to one another by heat bonding or the like. Preferably, the entire nipple 11 may be made of a thermoplastic elastomer and/or any plastic, elastomer or other suitable material may be used.

The base 14 is secured to the handle 20 via a concentric ring 17. The ring 17 is attached to the handle 20 or by a mating concentric handle ring 18 portion disposed as part of the handle 20. A lip 19 and/or recess may be concentrically or partially formed to retain the cover 30. The lip 19 may be formed at the outermost portion of the junction adjacent to the connection between the ring 17 and the annular mounting ring 18 of the handle 20.

The ring 17 is generally annular in shape and provides stiffness to the flexible base 14 of the nipple 11 to prevent an infant from collapsing the base 14, which would allow a large portion, or the entire soft portion of the collapsible pacifier 10 to fit into the infant's mouth. The ring 17 has an inner and outer edge that generally defines its radial thickness, and upper and lower surfaces that generally define its width. The thickness of the ring 17 may be a small fraction of the diameter of its outer periphery. However, the ring 17 may be any suitable thickness. To provide the necessary stiffness, the ring 17 may be made of a rigid material, such as but not limited to, a relatively stiff plastic, such as polyethylene or any other suitable material according to this subject disclosure.

Although an annular ring 17 is shown, it is possible to have any regular or irregular shape. For example, the ring 17 may be shaped like an ellipse, a crescent shape, a rectangle having rounded corners, a star, and an outline of an animal or the like. The inner periphery of the bond ring may be large enough to encompass at least one fold adjacent to the base 14 of the shaft 12 and a plurality of ventilation apertures located adjacent to the fold 15.

The outermost edge 14*b* of the base 14 may be secured between the ring 17 and the annular mounting ring 18. In another embodiment, the rings 17, 18 may be overmolded by a material of the base 14. Various methods for attaching the base ring to the nipple are possible, such as for example, but not limited to over molding, adhesive bonding, chemical bonding, heat welding and/or any other suitable method in accordance with this subject disclosure may be used.

Figure 4:
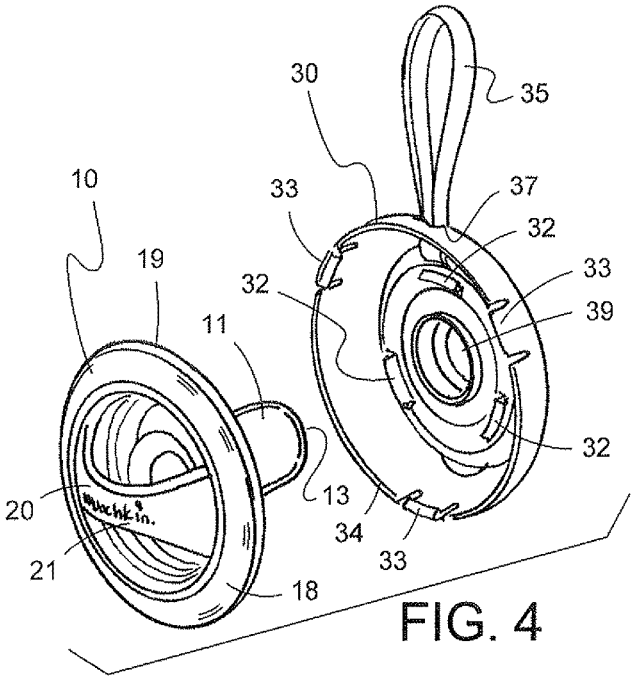
FIG. 4 illustrates an exploded perspective view of the compressible pacifier and cover combination.
Figure 5:
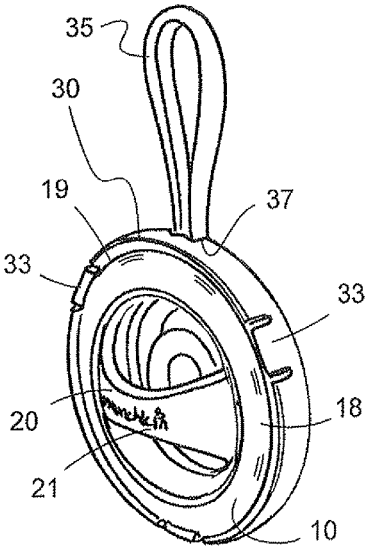
FIG. 5 shows a perspective view of the compressible pacifier attached to the cover.
Figure 6:
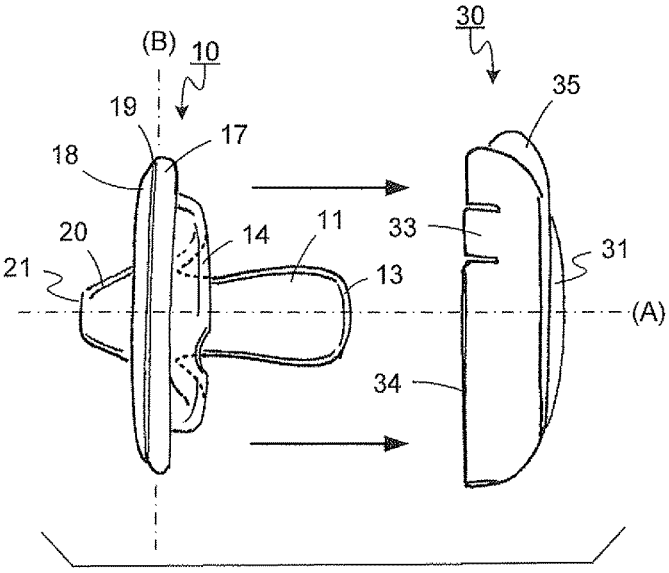
FIG. 6 depicts a side view of the compressible pacifier being attached to the cover.

FIGS. 4-7 depict various views showing the handle 20 in more detail. The handle 20 shown includes a generally elongate finger grip 21 and the annular mounting ring 18. The grip 21 is attached at its opposite ends to the annular mounting ring 18 at points that are generally diametrically opposed to one another. Preferably, the grip 21 is offset from a concentric plane (B) of the annular mounting ring 18 (as shown in FIG. 6), away from the lower surface of the annular mounting ring 18 to allow easier gripping of the finger grip 21 by an infant or an adult supervising an infant.

The grip 21 may be made of the same plastic as the ring 17 and may be integrally molded with the annular mounting ring 18. However, the grip 21 may be made of any suitable material, such as hard or soft plastic, natural or synthetic elastomer and/or any other suitable material. The grip 21 may also be constructed as a separate component from the annular mounting ring 18 and attached thereto by adhesive bonding, chemical bonding, heat welding, overmold or the like.

The annular mounting ring 18 may be attached to the ring 17 by sonic welding together along their entire concentric lengths to create a continuous bond there between. However, the mounting ring 18 alternatively may be attached to the ring 17 and/or the base 14 by an adhesive, chemical welding, heat welding and/or any other suitable attachment process material or process.

Figure 7:
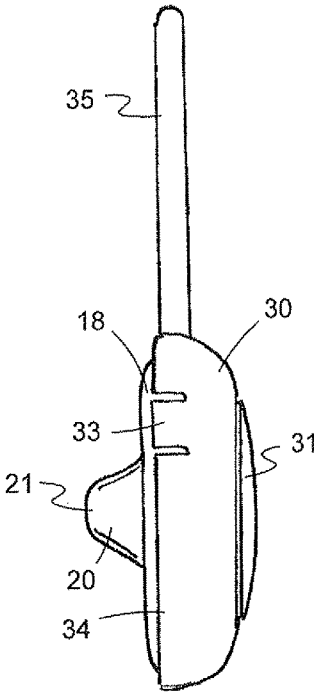
FIG. 7 illustrates a side view of the compressible pacifier attached to the cover.
Figure 8:
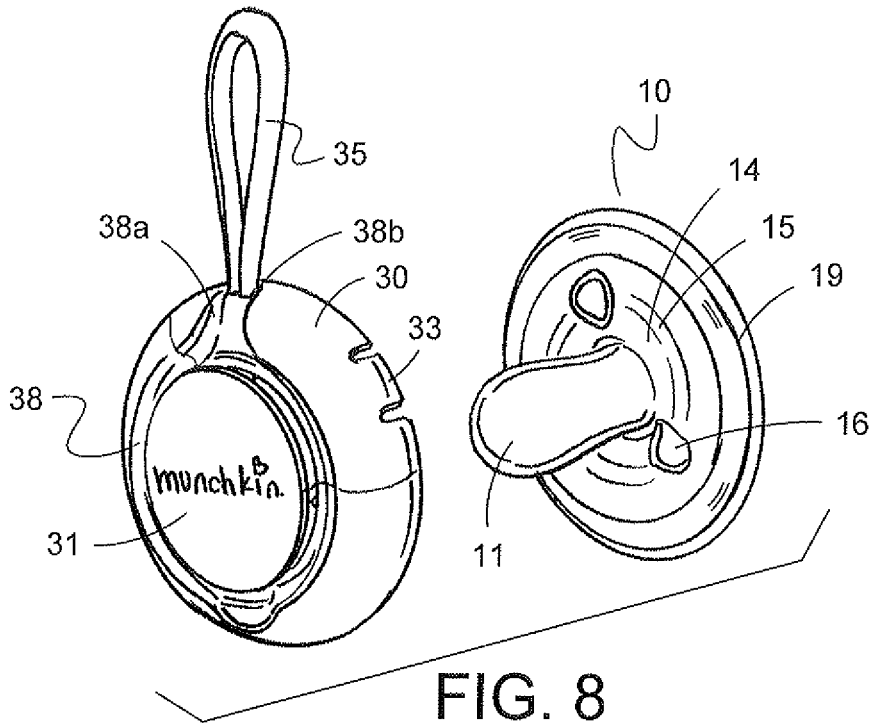
FIG. 8 depicts an exploded perspective rear view of the compressible pacifier and cover combination.
Figure 9:
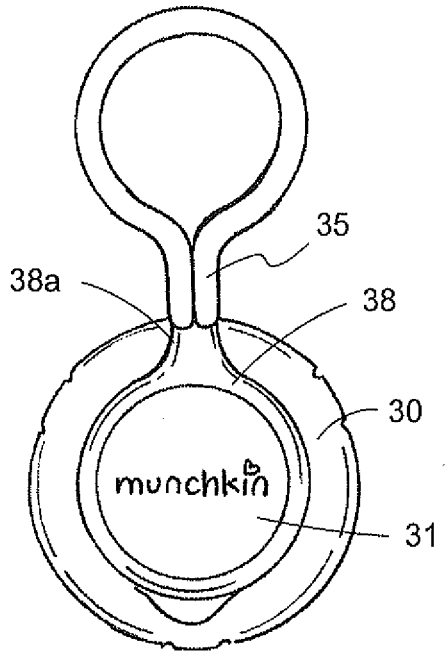
FIG. 9 shows a front view of the cover.

FIGS. 4-12 show various views of the cover 30 and the cover 30 being attached to the nipple 10. In FIGS. 4, 6 and 8, the nipple 10 and cover 30 are in alignment for assembly. FIGS. 7 and 9 illustrates the nipple 10 secured to the cover 30. FIGS. 11-12 show various views of the cover 30.

As shown, the cover 30 has a generally concentric clamshell shape. However, it is to be understood that the cover 30 can take various shapes as described and shown in detail later in FIGS. 18-21. In FIGS. 4 and 10-12, the inside surface of the front cover 30 includes a cup-shaped recess 39. During storage of the pacifier 10, the cup-shaped recess 39 is adapted to receive the tip 13 end of the nipple 11. That is, the tip 13 of the nipple 11 may be aligned and be fit into the recess 39 during the compression process in which the pacifier 10 is attached to the cover 30 as described in more detail below.

In FIGS. 6-11, the front of the cover 30 includes a front cap 31 portion, incorporated as part of, or attached to the cover 30. A peripheral edge of the front cap 31 may be used to border a channel 38 adapted to align and secure a flexible elastic band 35 to the cover 30. The front cap 31 can take any size or shape suitable for aligning and guiding the elastic band on the cover 30.

As shown in FIGS. 4, 10 and 12, the cap 31 can be attached by a plurality of snap fasteners 32 extending from the cap 31 and/or secured by a variety of different methods suitable for connecting the cap 31 to the cover 30. As shown from a rear view of the cover 30, the snap fasteners 32 may be disposed radially around the cap 31 within the cover 30.

FIGS. 4-12 illustrate various flexible notched projections 33 provided on the cover 30. The flexible notched projections 33 are disposed about the concentric peripheral edge 34 of the cover 30. The notched projections 33 are adapted to clasp onto a lip 19 disposed adjacent to the junction where the ring 17 meets the annular mounting ring 18.

As best shown in FIGS. 1 and 8-9, the front of the cover 30 includes a concentric recessed channel 38 having a recessed channel opening 38*a* extending from one end of the body of the concentric recessed channel 38 outward to substantially a peripheral edge 38*b* of the cover 30. The channel 38, 38*a*, 38*b* is provided to accommodate the insertion and securing of the flexible band 35 therein. The contour of the recess 38, 38*a*, 38*b* is constructed to grip and hold a length of the flexible band 35 therein as will be described in more detail below.

FIGS. 10 and 12 show a hook 26 attached to a back side of the cover 30. The elastic band 35 may be attached to the cover 30 in a variety of different ways. The flexible band 35 may be a closed loop band or a band whose open ends are attached to the cover 30.

As shown, the flexible band 35 is secured at a first end 35*a* to the hook 26. The flexible band 35 extends from its first end 35*a* from the hook 26 upward through an aperture 37 provided in cover 30 (as shown in FIGS. 4-5 and 10-12). It is to be understood that the flexible band 35 may be attached to the cover 30 in a plurality of different ways. For example, the flexible band can be over-molded instead of being fastened to the hook and/or any other suitable mode for attaching the flexible band to the cover.

As will be described later in FIGS. 18-22, the flexible band can be adapted to be secured to the pacifier itself. That is, various channels or retaining members may be provided on the pacifier itself to hold and secure the flexible band. In this way, the pacifier can be securely attached to a cover. Likewise, the flexible band 35 can be used in a variety of different ways and is adapted to provide various advantages according to this subject disclosure.

Figure 13:
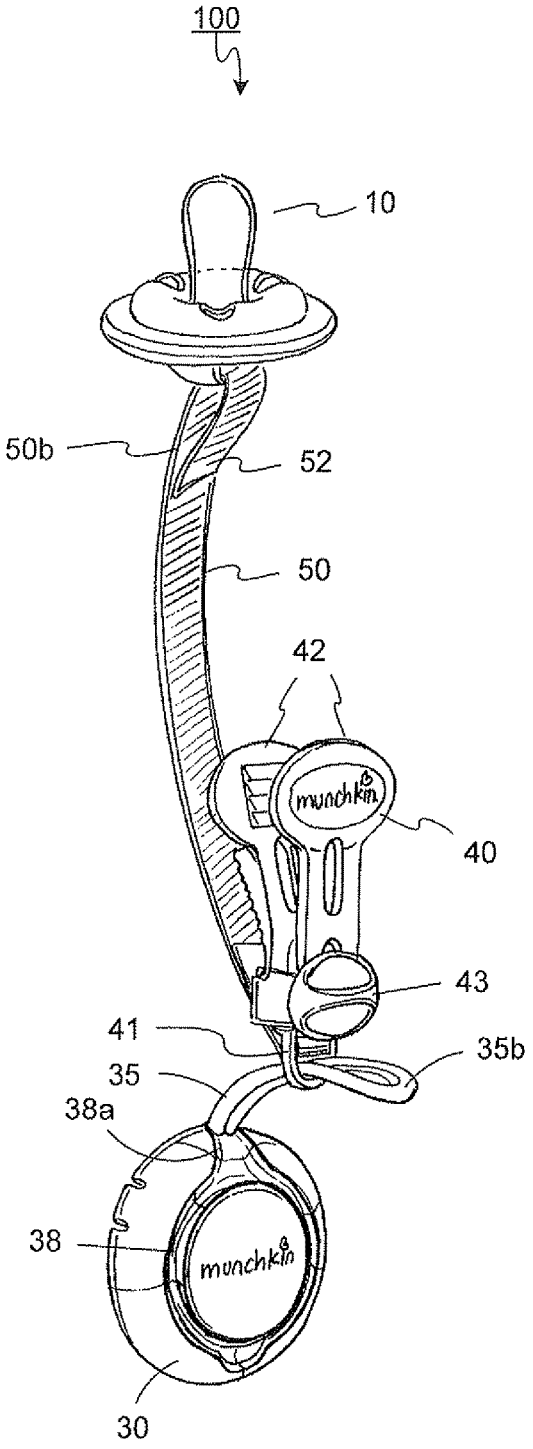
FIG. 13 illustrates a front perspective view of the cover being attached by the flexible band to the strap of the pacifier assembly.
Figure 14:
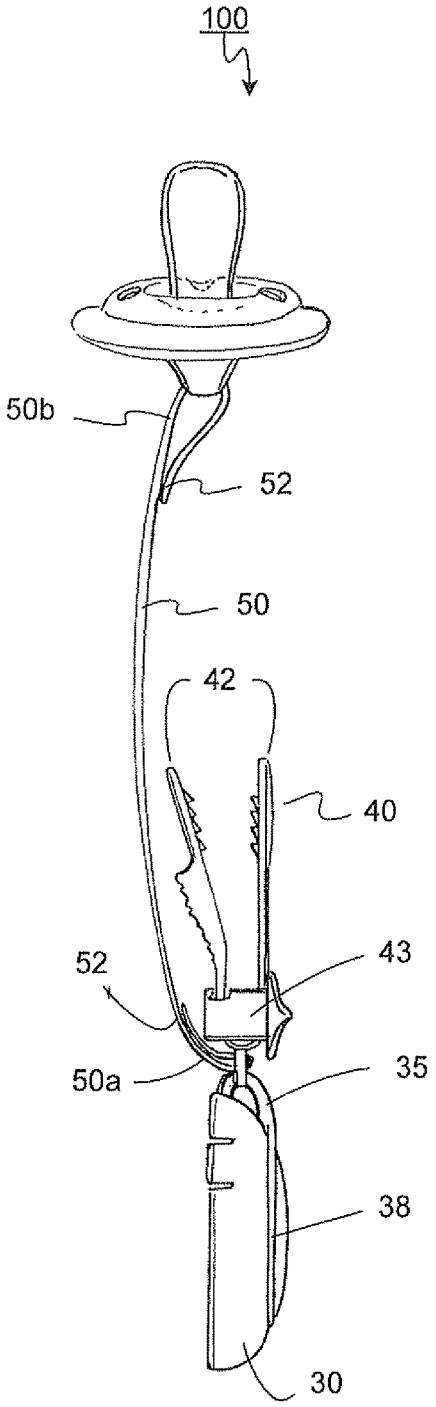
FIG. 14 depicts a side view of the pacifier assembly.

FIGS. 13-14, show in a first instance, the flexible band 35 adapted to secure the cover 30 to a loop 41 in the clip fastener 40 of the compressible pacifier assembly 100. The flexible band 35 is placed through the loop 41 and curled back onto the cover 30 and secured within the channel 38.

Alternatively, it is possible to use the flexible band 35 to add an additional pacifier 10 and cover 30 combination to the clip fastener 40. That is, referring briefly back to FIGS. 4-7, a compressible pacifier 10 may first be secured to the cover 30 as shown and described in the following manner. The tip 13 of the nipple 11 is first aligned with the recess 39 in the cover 30. The pacifier 10 is then compressed into the recess and against the cover 30 until the concentric notches 33 on the cover 30 engage and fasten themselves to an undercut (or securing ridge) in the lip 19 of the pacifier 10 as shown in FIG. 5. Once the pacifier 10 is attached to the cover 30, the flexible band 35 can then be connected to the clip fastener 40. Alternatively, it is to be understood that the flexible band 35 can be integrated into the pacifier 10 and operate similarly to secure the pacifier 10 to the fastener 40 to a cover 30 or to another pacifier.

Referring back to FIGS. 13-14, a second end 35*b* of the flexible band 35 is inserted through the loop 41 in the clip fastener 40. The second end 35*b* of the flexible band 35 may then be folded back onto the front of the cover 30 and inserted into, and secured within the concentric channels 38, 38*a* in the cover 30. The clip fastener 40 may also be attached to a first end 50*a* of a strap 50. At a second end 50*b* of the strap 50, the strap 50 can be fastened to the pacifier 10 in any suitable manner. For example, the second end 50*b* of the strap 50 may be attached to the pacifier 10 by a hook and loop fastening mechanism 52, such as with Velcro, snaps or the like. Likewise, the first end 50*a* of the strap 50 may be attached to the clip fastener 40 by a similar hook and loop fastening mechanism 52. Any suitable method for attaching the strap 50 to the various items can be provided according to this subject disclosure.

The clip fastener 40 includes a clip 42 adapted to be secured to a garment. The clip 42 has an adjustable tightening mechanism 43 that can incrementally clamp or tighten the clip 42 onto a preferred garment on the infant such that if the pacifier 10 happens to fall out of the infant's mouth, the pacifier 10 will be caught by the strap 50 secured to the garment thereby preventing the pacifier 10 from falling to the ground and contaminating the pacifier 10. Likewise, the strap 50 is also advantageous in permitting the pacifier 10 to be accessible to the infant at their disposal as it will be conveniently clipped at a location where the infant can readily grab it and use it whenever they choose. This convenience eliminates the reliance on the caregiver having to give the pacifier 10 to infant each time they desire the use of the pacifier 10.

Figure 15:
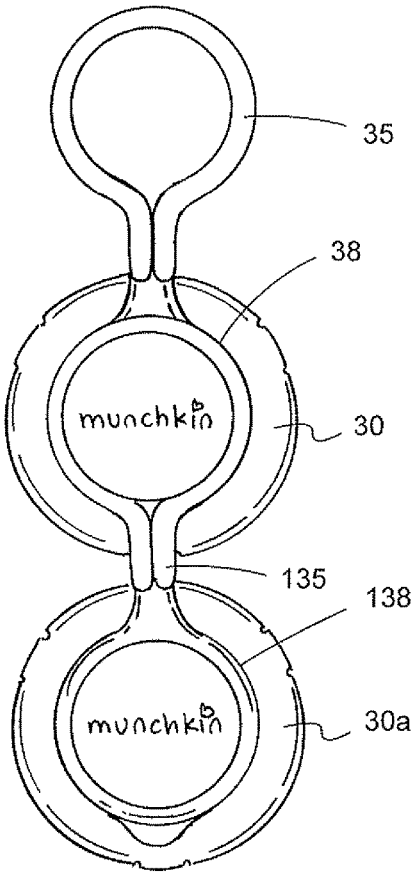
FIG. 15 shows a first cover attached to a second cover.
Figure 16:
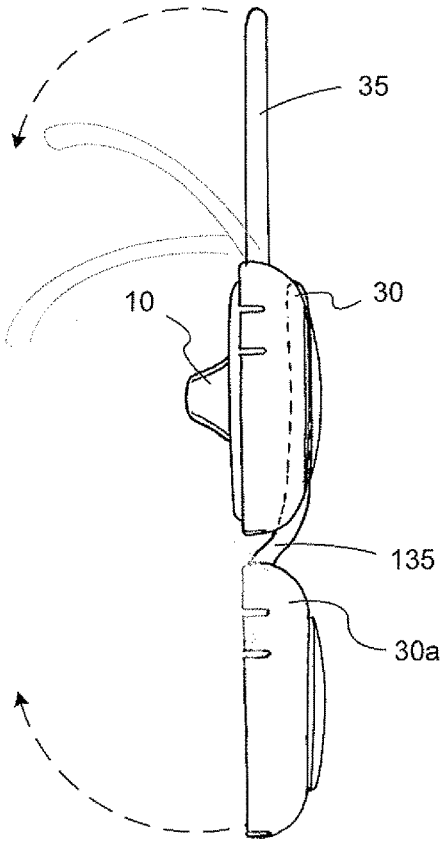
FIG. 16 illustrates the process taken to secure the first cover to the second cover over a pacifier.
Figure 17:
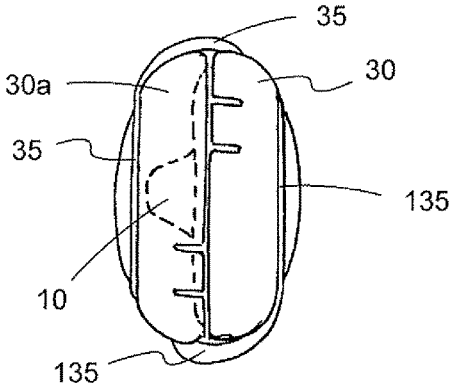
FIG. 17 depicts the first cover secured to the second cover over the pacifier.

FIGS. 15-17 depict a second instance in which the flexible strap 35 can be used to securely attach a first cover 30 to a second cover 30*a*, completely enclosing the pacifier 10 as shown in FIG. 17. That is, shown in FIG. 15, a second flexible band 135 of the second cover 30*a* can be used to secure the second cover 30*a* to the first cover 30.

As shown in FIG. 15, the second flexible band 135 of the second cover 30*a* is extended and secured into the channel 38 in the first cover 30. In FIG. 16, the second cover 30*a* can be folded clockwise onto the back of first cover 30. As such, the first cover 30 and the second cover 30*a* are positioned back to back as shown in FIG. 17. The first flexible band 35 can then be folded back down counter-clockwise onto the second cover 30*a* and inserted into, and secured within the concentric channel 138 (see FIG. 15) in the second cover 30*a*. As shown in FIG. 17, the first cover 30 is positioned back to back with the second cover 30*a*. The flexible bands 35, 135 are wrapped around the first cover 30 and the second cover 30*a* in a secure manner to prevent the first cover 30 from being disengaged from the second cover 30*a*. Conveniently, shown in FIG. 17, the pacifier 10 is enclosed between the two covers 30, 30*a* and secured free from external contamination.

The pacifier 10 can be embodied in a variety of different sizes, shapes and configurations. FIGS. 18-21 show another exemplary embodiment for the pacifier 10 and cover 30 combination according to the subject disclosure. The shape and structure of the pacifier housing 10 and the cover housing 30 are similar in shape and are adapted to mate with each other in a secure manner so that the notches 33 on the cover 30 are secured to a flange on the lip 19 on the pacifier 10.

Figure 18:
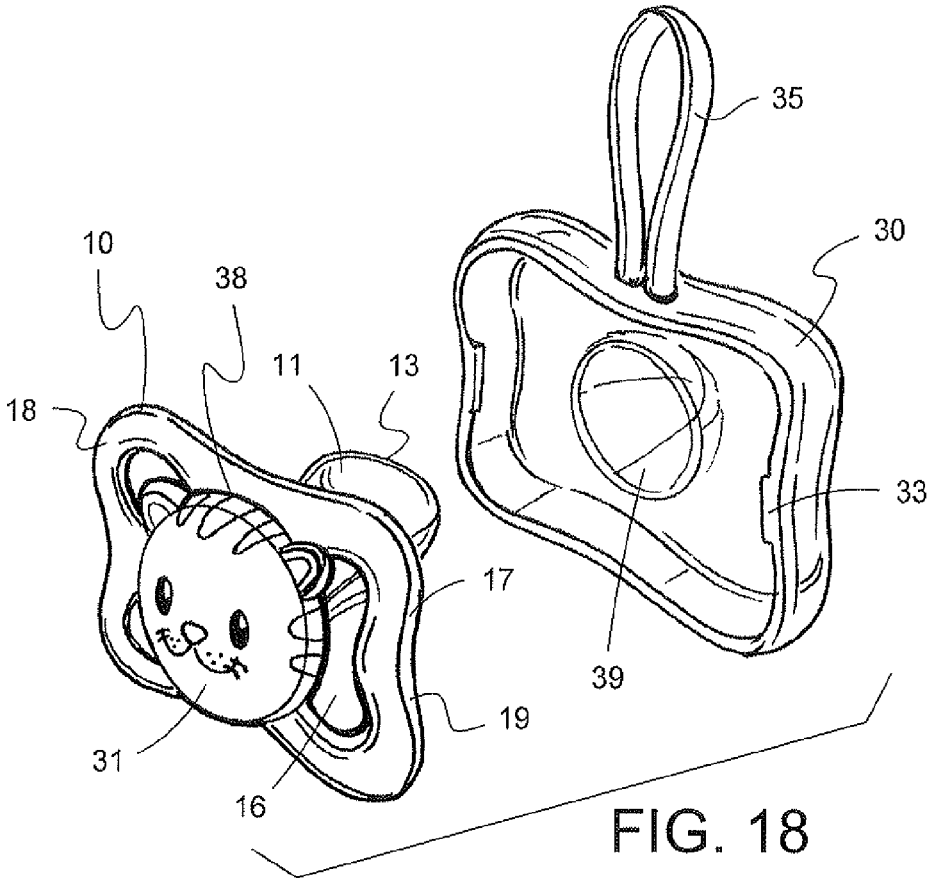
FIG. 18 shows a perspective view of an exploded view of another exemplary pacifier and cover combination.
Figure 19:
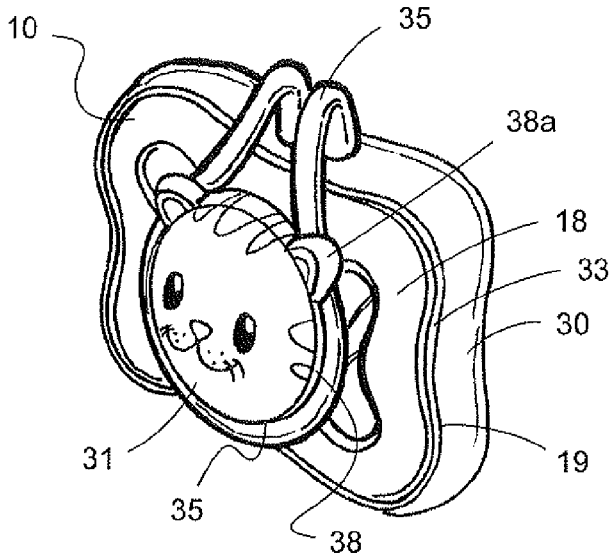
FIG. 19 shows a perspective view of the pacifier secured to the cover.
Figure 22:
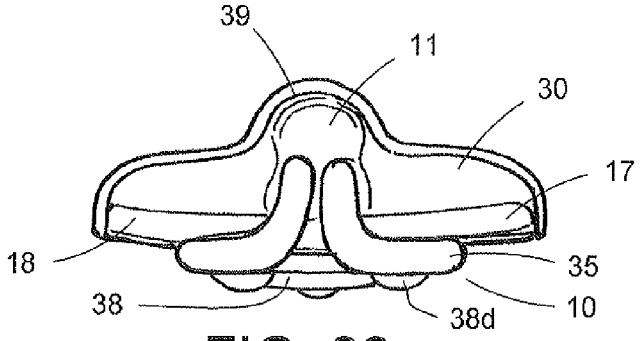
FIGS. 20-22 illustrate a front, rear and top view of the pacifier secured to the cover.
Figure 20:
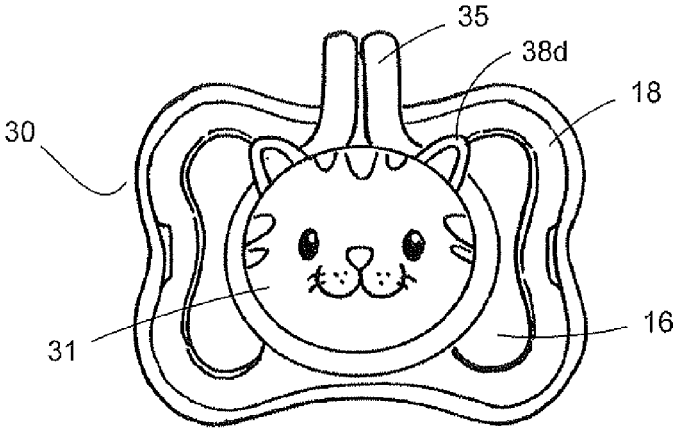
Figure 21:
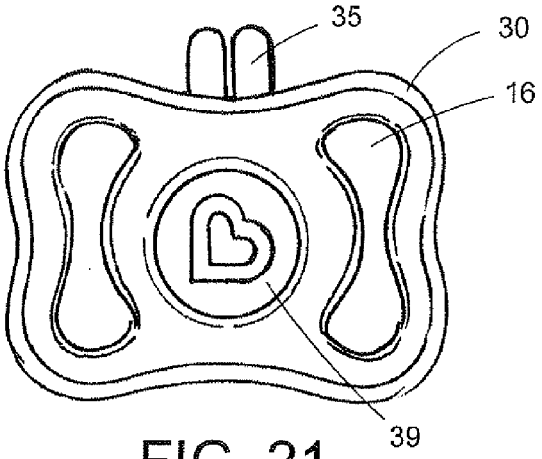

In FIG. 18, the pacifier 10 is shown disconnected from the cover 30, and in FIG. 19, the pacifier 10 is shown attached to the cover 30 and the flexible band 35 is shown secured to a channel 38 in the pacifier 10. As shown in FIGS. 18-20 and 21, the space or channel 38 is disposed around the cap 31 in the shape of a character. The cap 31 in this instance may also be the handle that the infant or care provider may grip onto. Various projections 38*d* on the character cap 31 can be used to define the space or channel 38 into which the flexible band 35 may be secured.

Similar to the description above, the tip 13 of the pacifier 11 is aligned and placed into a recess 39 disposed in the cover 30 when the pacifier 10 is to be secured to the cover 30. The vent apertures 16 are configured to allow the infant to breath when their mouth covers the pacifier 10.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

The invention claimed is:

1. A pacifier assembly, comprising:

a compressible pacifier, comprising:

a nipple having a tip and a radial base;

a ring;

a fold disposed between an end of the radial base and the ring adapted to enable the compressible pacifier to compress; and a handle comprising a finger grip, wherein a portion of the radial base is secured adjacent to the handle; and a plurality of covers having at least a first cover adapted to be secured to the compressible pacifier; the first cover including a cup-shaped recess adapted to receive the tip of the nipple wherein the tip is secured within the recess while the pacifier is compressed at its fold as a result of the pacifier being attached to the first cover:

a first flexible band interconnecting the plurality of covers;

wherein a recess channel of the first cover of the plurality of covers is adapted to receive and secure a second flexible band attached to a second cover of the plurality of covers and a recess channel of the second cover of the plurality of covers is adapted to receive and secure the first flexible band attached to the first cover of the plurality of covers.

2. The pacifier assembly as recited in claim 1, wherein the fold in the radial base comprises a generally semi-toroid shaped fold.

3. The pacifier assembly as recited in claim 2, wherein the fold has an inner periphery and an outer periphery, the inner periphery attached to a shaft of the nipple and the outer periphery attached to the ring.

4. The pacifier assembly as recited in claim 2, wherein a shaft of the nipple compresses along a longitudinal axis of the nipple when the nipple is secured to the first cover.

5. The pacifier assembly as recited in claim 1, wherein the handle further comprises an annular mounting ring wherein the finger grip is attached to the annular mounting ring.

6. The pacifier assembly as recited in claim 1, wherein the first cover is secured to the compressible pacifier by a plurality of snap fasteners.

7. The pacifier assembly as recited in claim 6, wherein the plurality of snap fasteners are disposed radially within the first cover.

8. The pacifier assembly as recited in claim 1, wherein the first cover has a plurality of flexible notched projections adapted to clasp onto a lip on the ring of the compressible pacifier.

9. The pacifier assembly as recited in claim 8, wherein the plurality of flexible notched projections are disposed about a concentric peripheral edge of the first cover.

10. The pacifier assembly as recited in claim 1, further comprising a strap having a clip attached to a first end of the strap, which in turn is attached to the first cover, and a second end attached to the compressible pacifier.

11. The pacifier assembly as recited in claim 1, wherein the flexible band is over-molded to the cover.

12. A pacifier assembly, comprising:

a compressible pacifier, comprising:

a nipple having a tip and a radial base;

a ring;

a fold disposed between an end of the radial base and the ring adapted to enable the compressible pacifier to compress; and a handle, wherein a portion of the radial base is secured adjacent to the handle and the ring;

a plurality of covers adapted to be secured to the compressible pacifier, a first cover of the plurality of covers comprising:

an internal cavity adapted to receive the compressible pacifier; and a cup-shaped recess adapted to receive the tip of the nipple wherein the tip is secured within the recess while the pacifier is compressed at its fold as a result of the pacifier being attached to the cover; and a first flexible band interconnecting the plurality of covers;

wherein a recess channel of the first cover of the plurality of covers is adapted to receive and secure a second flexible band attached to a second cover of the plurality of covers and a recess channel of the second cover of the plurality of covers is adapted to receive and secure the first flexible band attached to the first cover of the plurality of covers.

13. The pacifier assembly as recited in claim 12, wherein first cover of the plurality of covers is secured to the compressible pacifier by a plurality of snap fasteners and plurality of flexible notched projections.

14. The pacifier assembly as recited in claim 13, wherein the plurality of snap fasteners are disposed radially within the first cover of the plurality of covers and the plurality of flexible notched projections are disposed about a concentric peripheral edge of the second cover of the plurality of covers.

15. A pacifier assembly, comprising:

a compressible pacifier, comprising:

a nipple having a tip and a radial base;

a rigid ring;

a fold disposed between an end of the radial base and the ring adapted to enable the compressible pacifier to compress; and a handle, wherein a portion of the radial base is secured adjacent to the handle and the rigid ring; and a plurality of covers having a first cover adapted to be secured to the compressible pacifier, comprising:

an internal cavity adapted to receive the compressible pacifier;

a cup-shaped recess adapted to receive the tip of the nipple wherein the tip is secured within the recess while the pacifier is compressed at its fold as a result of the pacifier being attached to the cover;

a first flexible band; and a plurality of flexible notched projections disposed about a peripheral edge of the first cover;

wherein a recess channel of the first cover of the plurality of covers is adapted to receive and secure a second flexible band attached to a second cover of the plurality of covers and a recess channel of the second cover of the plurality of covers is adapted to receive and secure the first flexible band attached to the first cover of the plurality of covers.

16. The pacifier assembly as recited in claim 15, wherein the rigid ring defines vent apertures to form fluid communication between a mouth of a user and an external environment during use.

* * * * *